US005211390A

United States Patent [19]

Igaki

[11] Patent Number: 5,211,390

[45] Date of Patent: May 18, 1993

[54] SHEET FEEDING DEVICE

[75] Inventor: Masahiko Igaki, Tokyo, Japan

[73] Assignee: Canon Kabushiki Kaisha, Tokyo, Japan

[21] Appl. No.: 664,750

[22] Filed: Mar. 5, 1991

[30] Foreign Application Priority Data

Mar. 5, 1990 [JP] Japan ..... 2-53134

[51] Int. Cl.[5] ..... B65H 9/00

[52] U.S. Cl. ..... 271/250; 271/268; 271/251

[58] Field of Search ..... 271/250-252, 271/268

[56] References Cited

U.S. PATENT DOCUMENTS

| | | | |
|---|---|---|---|
| 3,929,327 | 12/1975 | Olson | 271/250 |
| 4,227,685 | 10/1980 | Fischer | 271/251 |
| 4,248,416 | 2/1981 | Seib | 271/251 |
| 4,349,188 | 9/1982 | Young | 271/250 |
| 4,426,073 | 1/1984 | Mizuma | 271/251 |
| 4,546,964 | 10/1985 | Linthout | 271/250 |
| 4,723,129 | 2/1988 | Endo et al. | 346/1.1 |
| 4,740,796 | 4/1988 | Endo et al. . | |
| 4,836,527 | 6/1989 | Wong | 271/251 |
| 4,919,318 | 4/1990 | Wong | 271/250 |
| 5,062,622 | 11/1991 | Kataoka et al. . | |
| 5,065,999 | 11/1991 | Kataoka et al. . | |
| 5,085,423 | 2/1992 | Nishimoto et al. . | |

FOREIGN PATENT DOCUMENTS

| | | | |
|---|---|---|---|
| 0404158 | 12/1990 | European Pat. Off. . | |
| 109345 | 6/1983 | Japan | 271/250 |
| 177243 | 6/1984 | Japan | 271/264 |

OTHER PUBLICATIONS

Garrison, S. P., et al., "Paper Feed", *IBM Technical Disclosure Bulletin*, vol. 22, No. 5, pp. 1746-1748. Oct. 1979.

Kroeker, E. B. "Cone Roller Couple", *IBM Technical Disclosure Bulletin*, vol. 25, No. 10, p. 5138. Mar. 1983.

*Primary Examiner*—Robert P. Olszewski
*Assistant Examiner*—Steven M. Reiss
*Attorney, Agent, or Firm*—Fitzpatrick, Cella, Harper & Scinto

[57] ABSTRACT

A sheet feeding device for feeding a sheet by a vibration wave includes a pair of rotatable rollers each having a rotary shaft orthogonal to the direction of conveyance of the sheet and substantially parallel to the surface of the sheet. The sheet feeding device is designed such that the sheet is nipped by and between the pair of rollers with suitable pressure, thereby eliminating lateral shift and inclination for any extraneous force applied to the sheet.

18 Claims, 5 Drawing Sheets

SHEET FEEDING DEVICE

BACKGROUND OF THE INVENTION

1. Field of the Invention

This invention relates to a sheet feeding device provided in various machines provided with a mechanism for feeding sheets, such as a calculator, a copying apparatus, a facsimile apparatus, a word processor and a typewriter, and particularly to a sheet feeding device utilizing a travelling vibration wave.

2. Related Background Art

A device of this kind has heretofore been designed such that as disclosed in Japanese Laid-Open Patent Application No. 59-177243, a travelling wave is formed in resilient members for nipping a sheet therebetween, whereby the sheet is fed.

The principle of sheet conveyance in the above-mentioned proposal will hereinafter be described with reference to FIG. 7 of the accompanying drawings.

A sheet 13 is nipped with a moderate pressure force by and between resilient members 11 and 12. Travelling flexural vibration (travelling wave) is formed in each of the resilient members 11 and 12, and the phase difference between these travelling waves are designed to be spatially 180° and therefore, the flexural vibrations of the respective resilient members 11 and 12 travel so that the convex portions thereof may always be opposed to the sheet 13 side. At this time, material points at which for example, the convex portions of the resilient members 11 and 12 lie generally make a motion describing an elliptical orbit. In FIG. 7, with regard to the resilient member 11, when the travelling wave travels to the right, the material point describes a clockwise elliptical orbit as shown. Thus, the direction of motion of the material points on the convex portions of the resilient members 11 and 12 are opposite to the direction of travel of the vibrations, and this works as a force which transports the sheet 13.

On the other hand, in the concave portions of the resilient members, there is created a sheet moving force in the same direction as the direction of travel, but this pressure force is small as compared with that in the convex portions and therefore, the frictional forces between the sheet 13 and the resilient members 11 and 12 are small and the sheet transporting forces are also small and thus, the sum total of the sheet transporting forces works in the direction opposite to the direction of travel of the aforedescribed flexural vibrations.

As a sheet feeding device using such a principle of sheet conveyance, there is one as shown in FIGS. 5 and 6 of the accompanying drawings. This sheet feeding device uses a pair of annular vibration members 11 and 12 of a track-like planar shape as vibration members, and electrostrictive elements 111 and 121 such as piezoelectric elements are fixed to those surfaces of the annular vibration members which are not opposed to each other. These electrostrictive elements 111 and 121 each are divided into two groups, and an alternating voltage which is 90° out of phase with respect to a voltage applied to one of the two groups may be applied to the other group. When the two AC voltages differing in phase from each other are applied to the two groups of each of the electrostrictive elements 111 and 121, travelling flexural vibrations travelling along the circumferential direction are created in the annular vibration members 11 and 12 by the aforedescribed theory and the sheet 13 is moved by being subjected to forces in the direction opposite to the direction of travel of the travelling flexural vibrations from the annular vibration members. The sheet feeding device using the track-shaped annular vibration members utilizes as a sheet conveying force a travelling flexural motion created in the straight portion of each vibration member, and in this sheet feeding device, the vibration members are disposed in such a manner that the straight portions thereof are equal to the direction of feeding of the sheet. In this sheet feeding device, if the two straight portions of the annular vibration members 11 and 12 are both in contact with the sheet 13, the sheet 13 will no longer move by being subjected to forces in opposite directions at one time and therefore, in this device, the design is made such that only the straight portions **11*a* and 12*a* of the vibration members 11 and 12 contact the sheet 13 and the other portions, including the straight portions 11*b* and 12*b* of the vibration members, are thin-walled so as not to contact with the sheet 13**.

The upper vibration member 11 is mounted on the tip end portion of an arm member 22 having a pin **22*a* supported by a bearing member 20*a* provided on the opposite side of a bottom plate 20, and imparts a pressure force to the sheet 13** by the gravity thereof.

Reference numeral 41 designates a sheet stand, and the reference numeral 21 denotes a sheet guide.

Also, the resilient members 11 and 12 are such that the vibration amplitude of the travelling wave differs between the inner side and the outer side of the resilient members and therefore, there is generated torsional vibration. Also, the amplitude becomes greater toward the outer side and therefore, elliptical motion of the material points occurs so that an inwardly directed force ($f_2$ in FIG. 6) may be created on the surfaces of the resilient members by the combination of the travelling vibration wave and the torsional vibration. Due to this torsional vibration, the locus of the material point on the surfaces of the resilient members is an ellipse about said shaft, and a moving force is created for the sheet in the tangential direction of this ellipse.

As a result, the sheet is fed substantially without inclination and lateral shift during the conveyance thereof.

Now, the sheet feeding device as described above is provided with the sheet guide 21 for preventing inclination and lateral shift, but has suffered from the disadvantage that actually, oblique movement of the sheet cannot be prevented by only the pressure force against the guides 21 like the force $f_2$ indicated in FIG. 6 which is created on the surface of the resilient member. For example, if in FIG. 6, an extraneous force $F_1$ is imparted to the sheet 13, the sheet 13 will be inevitably inclined (obliquely moved).

SUMMARY OF THE INVENTION

It is an object of the present invention to provide a sheet feeding device utilizing a vibration wave which can feed a sheet straight without causing the oblique movement or lateral shift of the sheet.

It is another object of the present invention to provide a sheet feeding device utilizing a travelling vibration wave which can feed a sheet straight by a simple construction without causing an oblique movement or lateral shift of the sheet.

Other objects of the present invention will become apparent from the following detailed description of the invention.

One aspect of this invention is a sheet feeding device for feeding a sheet by a vibration wave which is provided with a pair of rotatable rollers each having a rotary shaft orthogonal to the direction of conveyance of the sheet and substantially parallel to the surface of the sheet and which is designed such that the sheet is nipped by and between the pair of rollers with suitable pressure, thereby eliminating lateral shift and inclination for any extraneous force applied to the sheet.

DESCRIPTION OF THE PREFERRED EMBODIMENTS

Figure 5A:
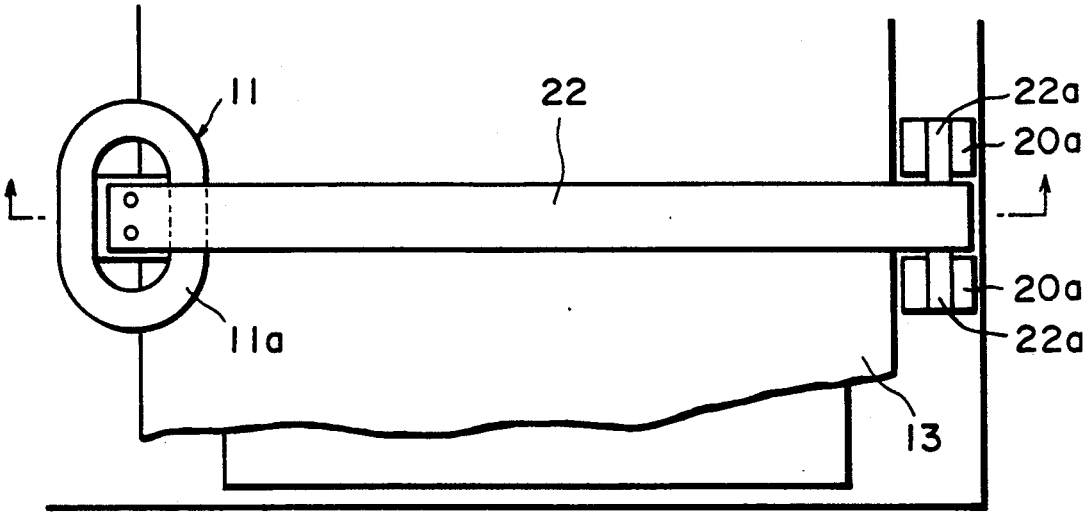
FIG. 5A PRIOR ART
FIGS. 5A and 5B are a top plan view and a cross-sectional view, respectively, showing the essential portions of a sheet feeding device according to the prior art.
Figure 5B:
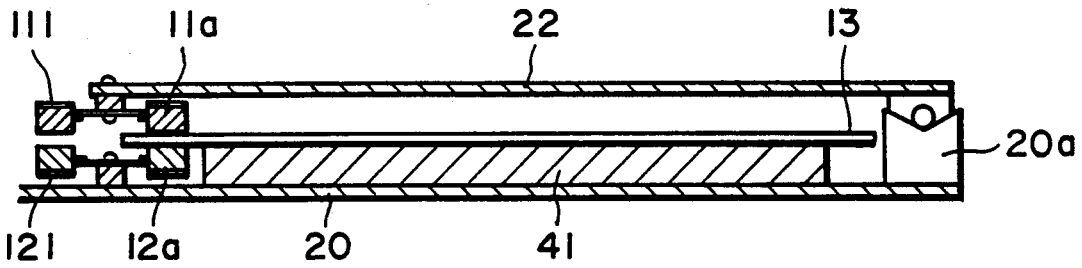
FIG. 5B PRIOR ART
Figure 6:
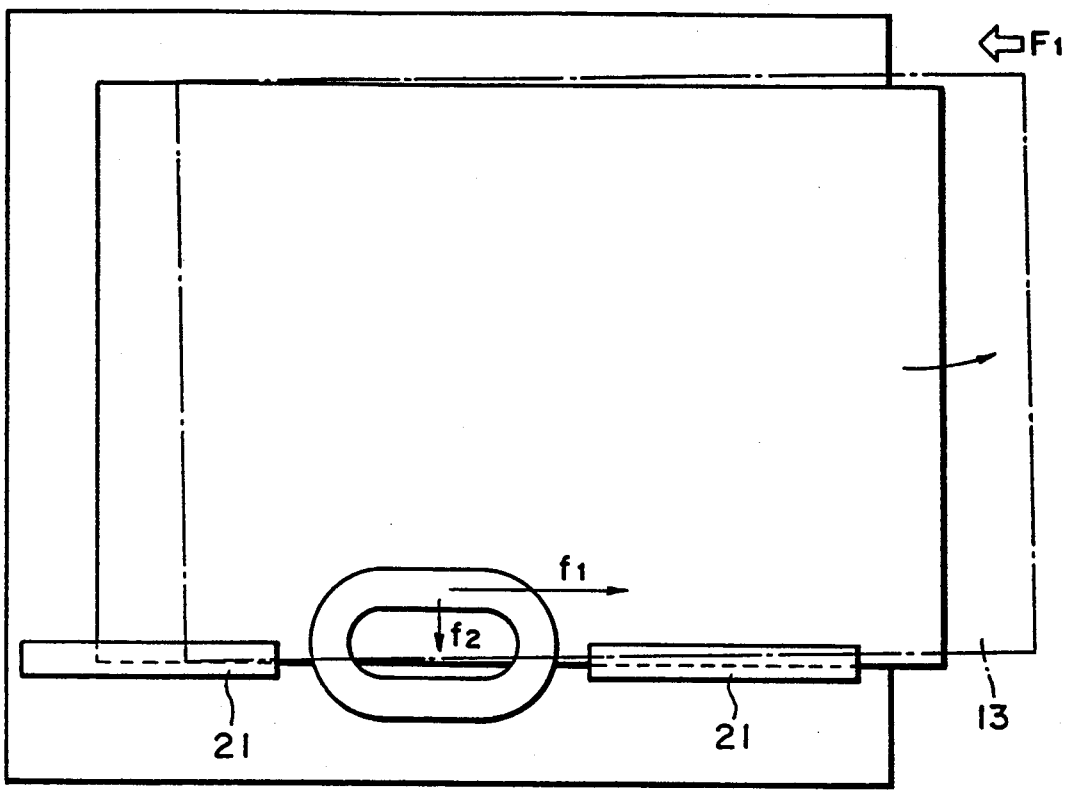
FIG. 6 PRIOR ART
FIG. 6 is a schematic top plan view of the sheet feeding device according to the prior art.
Figure 7:
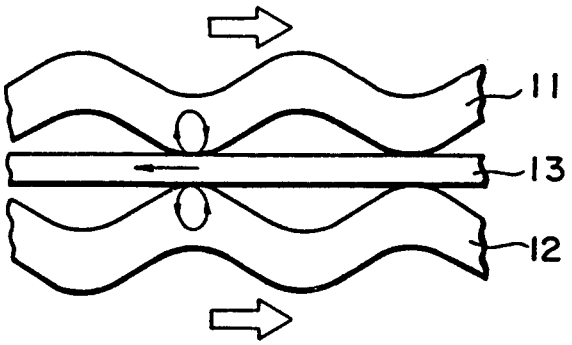
FIG. 7 PRIOR ART
FIG. 7 illustrates the principle of sheet conveyance.

The present invention will hereinafter be described in detail with respect to some embodiments thereof shown in the drawings, but members similar in structure to those in the example of the prior art shown in FIGS. 5 and 6 are given similar reference characters and need not be described.

Figure 1:
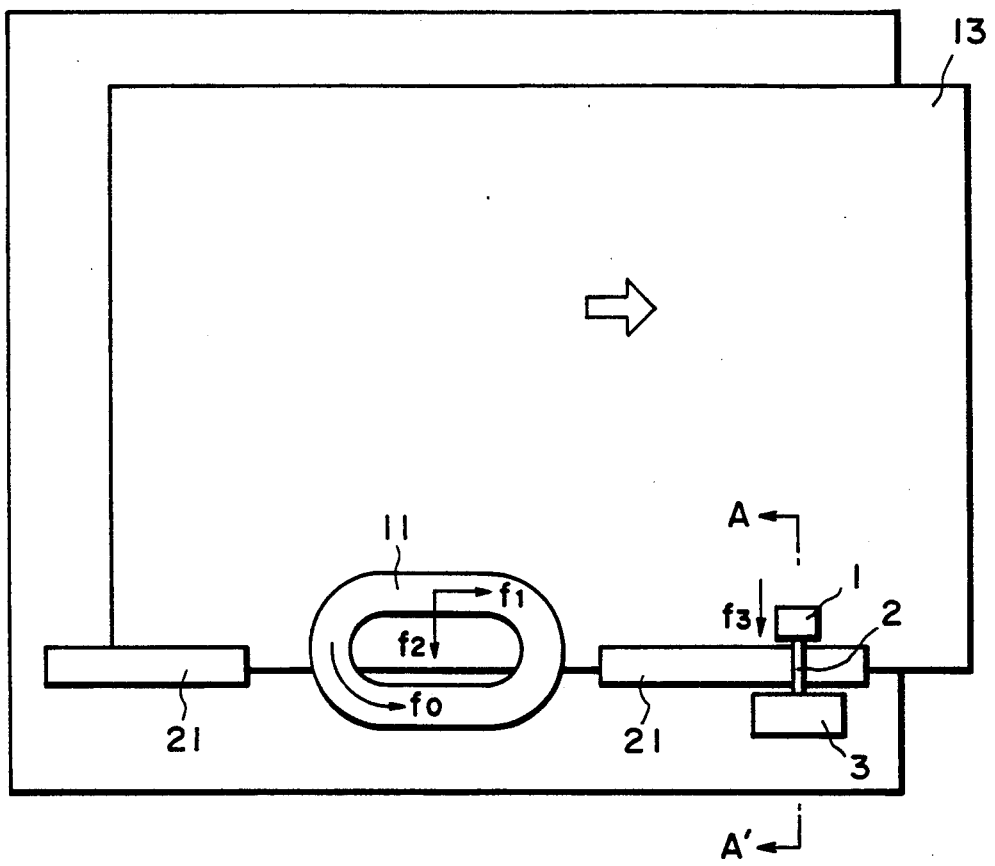
FIG. 1 is a top plan view showing embodiment 1 of a sheet feeding device according to the present invention.
Figure 2:
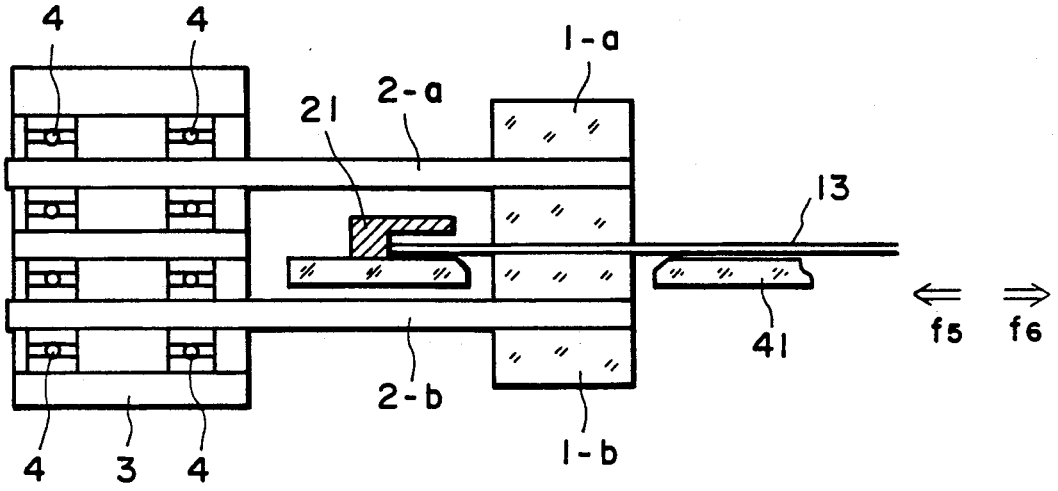
FIG. 2 is a cross-sectional view of the essential portions of the device of FIG. 1.

FIGS. 1 and 2 are schematic views showing the essential portions of a bubble jet type printer to which the present invention is applied. The bubble jet type printer is a printer as disclosed, for example, in U.S. Pat. No. 4,723,129 or No. 4,740,796, and briefly describing it, it generically refers to a printer of the type in which at least one driving signal corresponding to recording information and providing a rapid temperature rise exceeding nuclear boiling is applied to an electro-thermal transducer disposed correspondingly to a sheet or a liquid path retaining liquid (ink) therein to thereby generate heat energy in the electro-thermal transducer and cause thin film boiling on the heat actuating surface of a recording head with a result that a bubble in the liquid (ink) corresponding, one to one, to the driving signal is formed and the liquid (ink) is discharged through a discharge opening by the growth and shrinkage of the bubble to form at least one droplet, which is blown against the sheet to thereby form a character.

The printer of the present embodiment is such that when a circulative travelling vibration wave in the direction of arrow $f_0$ is generated in vibration members 11 and 12, a cut sheet 13 is driven forward in a direction $f_1$ opposite to the direction of arrow $f_0$.

Also, as previously described with respect to the example of the prior art, a force is created in the direction of arrow $f_2$ and acts as an urging force toward a sheet guide 21.

The reference characters 1-a and 1-b designate rubber rollers provided above and below the sheet 13, and the reference characters 2-a and 2-b denote rotary shafts having the rubber rollers 1-a and 1-b fixed to the end portions thereof. The rotary shafts 2-a and 2-b are supported by a bearing 3 having ball bearings 4 so as to be substantially orthogonal to the direction of conveyance of the sheet 13 and moreover parallel to the surface of the sheet 13. The rubber rollers 1-a and 1-b are mounted with suitable contact pressure so as to rotate about the shafts 2*a* and 2*b*, respectively, with the movement of the sheet 13.

Also, the rubber rollers 1-a and 1-b are designed such that they do not deviate relative to the direction of thrust.

The pair of rubber rollers 1-a and 1-b constructed as described above are provided upstream of the vibration members 11 and 12 with respect to the direction of conveyance of the sheet and on the sheet guide 21 side, whereby even if a force orthogonal to the direction of conveyance of the sheet like an extraneous force $f_5$ or $f_6$ is applied to the sheet 13, it will become possible to prevent the lateral shift of the sheet 13 by the frictional forces of the rubber rollers 1-a, 1-b.

EMBODIMENT 2

Figure 3A:
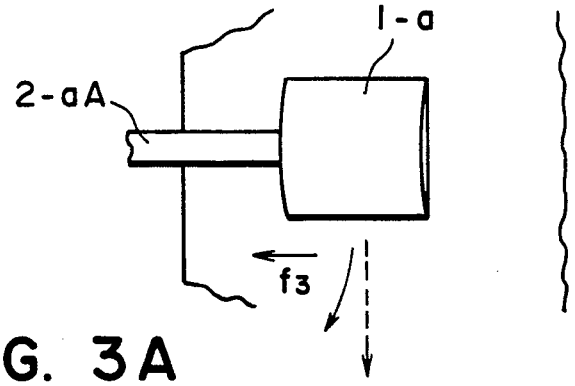
FIGS. 3A and 3B are a top plan view and a cross-sectional view, respectively, showing embodiment 2.
Figure 3B:
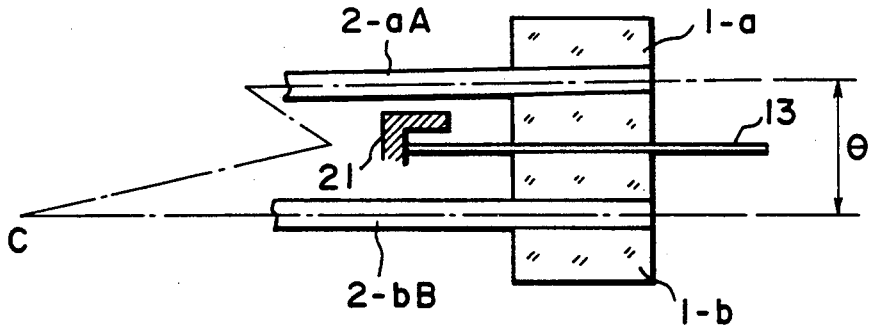

FIGS. 3A and 3B are a plan view and a cross-sectional view, respectively, showing the essential portions of embodiment 2 of the present invention.

In this embodiment, the lateral shift of the sheet 13 from an extraneous force is prevented by the utilization of the fact that a shaft 2-aA supporting the upper rubber roller 1-a is slightly inclined by an angle $\theta$, whereby when the roller is rotated by the movement of the cut sheet 13, a force which urges the sheet 13 against the sheet guides 21 is created.

In this case, by using a force $f_2$ which urges the sheet 13 against the sheet guide 21 more positively than in the above-described embodiment 1, a greater effect for preventing lateral shift can be expected. EMBODIMENT 3

Figure 4A:
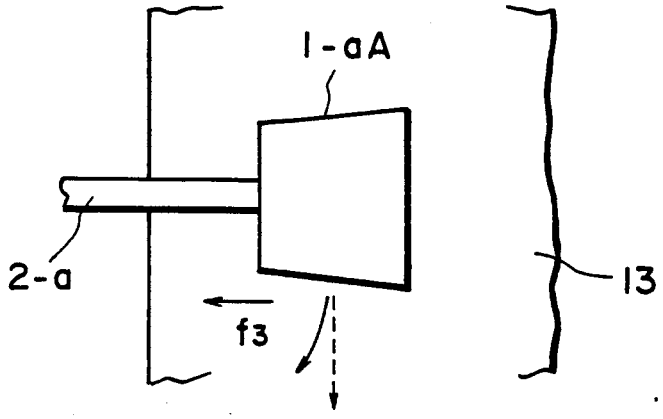
FIGS. 4A and 4B are a top plan view and a cross-sectional view, respectively, showing embodiment 3.
Figure 4B:
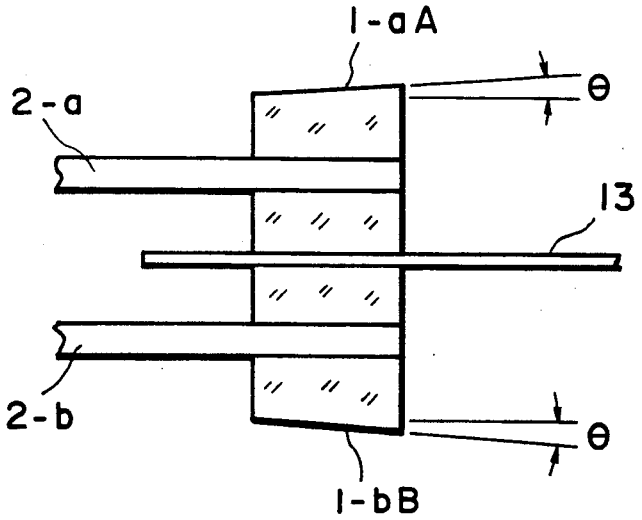

FIGS. 4A and 4B show embodiment 3.

This embodiment is such that a force which urges the sheet against the guide 21 is created by rubber rollers to thereby prevent lateral shift.

In this embodiment, the shafts are not inclined as in embodiment 2, but the inner thickness of rubber rollers 1-aA and 1-bB are varied in the direction of thrust, that is, the cross-sectional areas of the rubber rollers 1-aA and 1-bB in a direction along the direction of conveyance are varied as shown in thereby form a conical shape, and a force $f_3$ which urges the sheet against the guide 21 is created.

As described above, according to the present invention, the sheet is nipped by and between a pair of or more rubber rollers as rotatable members rotatable in the direction of conveyance of the sheet, whereby the sheet can be fed straight without the oblique movement or lateral shift of the sheet being caused.

Also, by forming the rollers into a conical shape or inclining the rotary shafts of the rollers, a lateral force can be positively imparted to the sheet, whereby the oblique movement or lateral shift of the sheet can be prevented more reliably and the sheet can be fed straight along the sheet guide or the like.

I claim:

1. A sheet feeding device comprising:

(a) a sheet guide for restricting a direction of conveyance of a sheet to a predetermined direction;

(b) a vibration member adapted to contact the sheet and responsive to an applied electrical signal to generate a travelling vibration wave for feeding the sheet in the predetermined direction, said vibration member creating a first force for feeding the sheet in the predetermined direction and a second force for urging the sheet toward said sheet guide; and (c) a rotatable member rotated in response to the feeding of the sheet, said rotatable member imparting to the sheet a force urging the sheet toward said sheet guide by said rotation and being disposed closer to a discharge side of said device in said direction of conveyance than said vibration member.

2. A sheet feeding device according to claim 1, wherein said vibration member is of an elliptical shape, and one straight portion thereof is provided along said direction of conveyance.

3. A sheet feeding device according to claim 1, wherein said vibration member is a loop-shaped member of which one straight portion is provided along said direction of conveyance, and wherein the amplitude of the outer peripheral side of said loop-shaped member is higher than the amplitude of the inner peripheral side thereof.

4. A sheet feeding device according to claim 1, wherein said sheet guide includes a portion extending straight along said direction of conveyance and contacting with the sheet.

5. A sheet feeding device according to claim 1, further comprising a shaft wherein said rotatable member is in contact with the sheet and is supported by said shaft.

6. A sheet feeding device according to claim 5, wherein said shaft is provided substantially orthogonally to said direction of conveyance.

7. A sheet feeding device according to claim 1, wherein said rotatable member includes a pair of rollers provided at opposed locations with the sheet interposed therebetween.

8. A sheet feeding device according to claim 1, wherein said rotatable member is provided on the sheet guide side.

9. A sheet feeding device according to claim 1, wherein said sheet is a cut sheet having a predetermined length.

10. A sheet feeding device according to claim 1, wherein said rotatable member is a rubber roller.

11. A sheet feeding device according to 1, wherein said vibration member is formed by a pair of vibration elements of which one straight portion alone contacts the sheet and wherein straight portions of said vibration member are provided at opposed locations with the sheet interposed therebetween.

12. A sheet feeding device, comprising:

(a) a sheet guide for restricting a direction of conveyance of a sheet to a predetermined direction;

(b) a vibration member adapted to contact the sheet and responsive to an applied electrical signal to generate a travelling vibration wave for feeding the sheet in the predetermined direction, said vibration member creating a first force for feeding the sheet in the predetermined direction and a second force for urging the sheet toward said sheet guide; and (c) a rotatable member rotated in response to the feeding of the sheet, said rotatable member imparting to the sheet a force urging the sheet toward said sheet guide by said rotation, a surface of said rotatable member in a direction substantially perpendicular to the sheet being sloped.

13. A sheet feeding device for a printer comprising:

(a) a sheet guide for restricting the direction of conveyance of a sheet to a predetermined direction;

(b) a vibration member adapted to contact the sheet and responsive to an applied electrical signal to generate a travelling vibration wave for feeding the sheet in the predetermined direction, said vibration member creating a first force for feeding the sheet in the predetermined direction and a second force for urging the sheet toward said sheet guide; and (c) a rotatable member rotated in response to the feeding of the sheet, said rotatable member imparting to the sheet a force urging the sheet toward said sheet guide by said rotation and being disposed closer to a discharge side of said device in said direction of conveyance than said vibration member.

14. A sheet feeding device for a printer according to claim 13, wherein the printer is a bubble jet printer.

15. A sheet feeding apparatus comprising:

(a) a sheet guide for restricting the direction of conveyance of a sheet to a predetermined direction;

(b) a vibration member adapted to contact the sheet and responsive to an applied electrical signal to generate a biasing force for feeding the sheet in the predetermined direction, said vibration member creating a first force for feeding the sheet in the predetermined direction and a second force for urging the sheet toward said sheet guide; and (c) a rotatable member rotated in response to the feeding of the sheet, said rotatable member imparting to the sheet a force urging the sheet toward said sheet guide by said rotation and being disposed closer to a discharge side of said device in said direction of conveyance than said vibration member.

16. A sheet feeding device comprising:

(a) a sheet guide for restricting the direction of conveyance of a sheet to a predetermined direction;

(b) a vibration member adapted to contact the sheet and responsive to an applied electrical signal to generate a biasing force for feeding the sheet in the predetermined direction; and (c) a rotatable member rotated in response to the feeding of the sheet, said rotatable member imparting to the sheet a force urging the sheet toward said sheet guide by said rotation and being disposed closer to a discharge side of said device in said direction of conveyance than said vibration member.

17. A sheet feeding device, comprising:

(a) a sheet guide for restricting a direction of conveyance of a sheet to a predetermined direction;

(b) a vibration member adapted to contact the sheet and responsive to an applied electrical signal to generate a travelling vibration wave for feeding the sheet in the predetermined direction, said vibration member creating a first force for feeding the sheet in the predetermined direction and a second force for urging the sheet toward said sheet guide;

(c) a rotatable member rotated in response to the feeding of the sheet, said rotatable member imparting to the sheet a force urging the sheet toward said sheet guide by said rotation and being disposed closer to a discharge side of said device in said direction of conveyance than said vibration member; and (d) a member for rotatably supporting said rotatable member at a predetermined position, said rotatable support member having a rotation axis thereof which is disposed at a predetermined angle with respect to a surface of the sheet.

18. A sheet feeding device, comprising:

(a) a sheet guide for restricting the direction of conveyance of a sheet to a predetermined direction;

(b) a vibration member adapted to contact the sheet and responsive to an applied electrical signal to generate a travelling vibration wave for feeding the sheet in the predetermined direction, said vibration member creating a first force for feeding the sheet in the predetermined direction and a second force for urging the sheet toward said sheet guide; and (c) a rotatable member rotated in response to the feeding of the sheet, said rotatable member imparting to the sheet a force urging the sheet toward said sheet guide by said rotation and being disposed closer to a discharge side of said apparatus in said direction of conveyance than said vibration member, a surface of said rotatable member in a direction substantially perpendicular to the sheet conveyance direction being sloped.

* * * * *

UNITED STATES PATENT AND TRADEMARK OFFICE

CERTIFICATE OF CORRECTION

PATENT NO. 5,211,390

DATED May 18, 1993

INVENTOR(S) Masahiko IGAKI

It is certified that error appears in the above-indentified patent and that said Letters Patent is hereby corrected as shown below:

ON THE TITLE PAGE:

[56] Foreign Patent Documents:
"177243 6/1984 Japan" should read --59-177243 10/1984 Japan--.

COLUMN 4
Line 34, "EMBODI-" should be deleted.
Line 35, "MENT 3" should read --EMBODIMENT 3--.

COLUMN 5
Line 40, "said" should read --the--.

Signed and Sealed this

Eighth Day of March, 1994

Bruce Lehman

BRUCE LEHMAN

*Commissioner of Patents and Trademarks*

*Attest:*

*Attesting Officer*